United States Patent [19]

Mukunoki

[11] Patent Number: 4,895,791

[45] Date of Patent: Jan. 23, 1990

[54] SILVER HALIDE PHOTOGRAPHIC ELEMENT CONTAINING A POLYMER LATEX

[75] Inventor: Yasuo Mukunoki, Kanagawa, Japan

[73] Assignee: Fuji Photo Film Co., Ltd., Kanagawa, Japan

[21] Appl. No.: 87,841

[22] Filed: Aug. 21, 1987

[30] Foreign Application Priority Data

Aug. 21, 1986 [JP] Japan ..... 61-195788

[51] Int. Cl.[4] ..... G03C 1/76

[52] U.S. Cl. ..... 430/523; 430/531; 430/539; 430/529; 430/634; 430/636; 430/637

[58] Field of Search ..... 430/637, 636, 634, 529, 430/523, 531, 533

[56] References Cited

U.S. PATENT DOCUMENTS

| | | | |
|---|---|---|---|
| 3,791,831 | 2/1974 | von Bonin et al. | 430/529 |
| 3,811,889 | 5/1974 | Endou et al. | 430/634 |
| 4,147,550 | 4/1979 | Campbell et al. | 430/529 |
| 4,268,623 | 5/1981 | Sera et al. | 430/529 |
| 4,345,016 | 8/1982 | Takahashi et al. | 430/634 |
| 4,388,402 | 6/1983 | Mukunoki et al. | 430/529 |
| 4,391,903 | 7/1983 | Sysak | 430/654 |
| 4,396,708 | 8/1983 | Ogawa et al. | 430/529 |
| 4,490,462 | 12/1984 | Kawaguchi et al. | 430/634 |
| 4,677,050 | 6/1987 | Yokoyama et al. | 430/629 |

*Primary Examiner*—Jack P. Brammer

*Attorney, Agent, or Firm*—Sughrue, Mion, Zinn, Macpeak & Seas

[57] ABSTRACT

A silver halide photographic material comprising a support having thereon at least one silver halide emulsion layer, silver halide photographic material containing in the at least one silver halide emulsion layer or at least one other constituting layer a latex having repeating units represented by the following general formula (I):

(I)

wherein A represents a group having a dissociating group which has a pKa of about 4 or lower, said pKa being measured at 25° C. in water; $R_1$, $R_2$, and $R_3$, which may be the same or different, each represents a hydrogen atom, a halogen atom, a substituted or unsubstituted alkyl group having 1 to 30 carbon atoms, a substituted or unsubstituted alkenyl group having 1 to 30 carbon atoms, a substituted or unsubstituted aryl group having 1 to 30 carbon atoms, a carboxyl group, an alkyloxycarbonyl group, or an alkylcarbonyloxy group; B represents a unit derived from a monomer copolymerizable with a monomer containing A; and a and b represent numbers of repeating units with a molar ratio of a to b being about 1.5/98.5 to about 50/50; the latex containing at least one compound selected from the group consisting of (a) a polymer having the following general formula (II):

(II)

wherein D represents a hydroxy group or a substituted or unsubstituted polyoxyalkylene group; $R_4$, $R_5$, and $R_6$ have the same meaning as defined above for $R_1$, $R_2$, and $R_3$ in formula (I); E represents a unit derived from a monomer copolymerizable with a monomer containing D and has the same meaning as defined above for B in formula (I); and d and e represent numbers of repeating units with the molar ratio of d to e being about 100/0 to about 5/95, (b) a water-insoluble low molecular weight compound having the following general formula (III):

F—G (III)

wherein F represents a substituted or unsubstituted alkyl, alkenyl or aryl group having 14 or more carbon atoms; and G represents a hydroxy group, or a substituted or unsubstituted polyoxyalkylene group, (c) a cellulose derivative, or (d) a starch derivative, the at least one compound being present in an amount of about 1.5 wt % or more based on the solid weight of the latex.

8 Claims, No Drawings

SILVER HALIDE PHOTOGRAPHIC ELEMENT CONTAINING A POLYMER LATEX

FIELD OF THE INVENTION

The present invention relates to a silver halide photographic material (hereinafter referred to as a photographic material), and more particularly, to a photographic material wherein at least one structural layer contains a polymer latex exhibiting stability over time.

BACKGROUND OF THE INVENTION

Generally, photographic materials containing a silver halide emulsion are subjected to various types of pressure in practical use. For example, when a conventional negative film for photography is taken up into a cartridge or is loaded into a camera, it will be bent or pulled from one exposure to the next. Also, other types of films (such as photographic materials for printing and radiographic materials for medical use such as X-ray films) are usually handled manually, they are frequently bent. Further, all types of photographic materials are subject to a great degree of pressure or stress when they are cut and worked on, such as in editing cinema films.

Thus, when various types of pressure or stress are applied to photographic materials, such will be exerted on the silver halide grains via the plastic film serving as a support or the gelatin (that is, a binder), supporting the silver halide grains, and the thus stressed part will often become fogged, desensitized or sensitized. When this happens, not only is the quality of the photographic image remarkably damaged, but also there could be risks which may lead to misdiagnosis in the case of reading radiographic materials or the like, which should be avoided at all costs. Such undesirable changes in photographic characteristics caused by these types of pressure or stress are reported in detail, for example, by K. B. Mather in *Journal of Optical Society of America,* 38, 1054 (1948), by P. Faelens and P. de Smet in *Sei. et. Industry Photography* 25, No. 5, 178 (1954), and by P. Faelens in *Journal of Photographic Science,* 2, 105 (1954).

Therefore, photographic materials whose photographic characteristics would not be influenced at all by the types of pressure and stress mentioned above have been keenly desired.

To improve such "pressure characteristics", it is known to decrease the silver halide/gelatin ratio of the silver halide emulsion and the method of adding an emulsifying agent to the photographic material but both of methods are insufficient. Specifically, for example, when the amount of gelatin is increased, the speed of the development treatment decreases, and when an emulsion is added, the mechanical strength of the emulsion layer decreases or the adaptability to high speed application becomes unfavorable.

On the other hand, it is also known that when a combination of gelatin and a synthetic polymer latex is used as a binder vehicle of a silver halide emulsion, the pressure characteristics can be prevented from worsening, without the above disadvantages. For example, in U.S. Pat. No. 3,632,342, it is disclosed that an acrylic acid type polymer latex is added to a silver halide emulsion layer for this purpose.

When a polymer latex is added to a silver halide emulsion, care must be taken to ensure the stability of the polymer latex to electrolytes. Since a polymer latex stabilized with an anionic surface active agent exhibits a quite low electrolyte stability, if the polymer latex is added directly to an emulsion, it together with the emulsion precipitates and the application becomes impossible. However, if a nonionic surface active agent is added to a latex, and then the latex is added to an emulsion, or if a latex prepared using, as an emulsifier, a surface active agent mixture of an anionic surface active agent and a nonionic surface active agent, which is added to an emulsion, the stability can be improved substantially. It has been reported in *Kogyo Kagaku Zasshi,* 64, 412 (1961) that the extent of this improvement is such that the greater the number of moles of ethylene oxide of a nonionic surface active agent added, the higher the improvement, as to effects of electrolyte stability observed. Further, the greater the amount of the nonionic surface active agent added, that is, the higher the concentration of the nonionic surface active agent, the higher the electrolyte stability.

Still further, in Japanese Patent Publication No. 54782/82, a method is disclosed of adding, to a coating composition, a polymer latex component impregnated with a nonionic surface active agent having ethylene oxide added thereto, as an antistatic agent. The anionic and/or nonionic surface active agents having added ethylene oxide disclosed in the *Kogyo Kagaku* publication and Japanese Patent Publication mentioned above, improve the electrolyte stability of the polymer latex on the one hand, while on the other hand, when the silver halide photographic material using the polymer latex is developed, undesirable development occurs in such a manner that portions where pressure is applied to the silver halide emulsion film (by, for example, a roller of an automatic developing machine) are fogged in the form of black spots on the resulting image (hereinafter referred to as black speckled marks).

Although a greater number of the moles of ethylene oxide added to a nonionic surface active agent and a greater added amount of such a nonionic surface active agent will result in improved electrolyte stability of the polymer latex, the amount of black speckled marks is increased accordingly. When conventional nonionic surface active agents are used, in particular, to be applied to radiographic materials, the sensitizing paper (screen) used in photographing is stained due to the contact of the sensitizing paper with the radiographic material. As a result, the radiographic material after development would have speckled or reticulate density unevenness (hereinafter referred to as screen stain), and the commercial value of the resulting product is damaged considerably.

Further, these surface active agents used as a stabilizer diffuse to the surface of the photographic material, thus rendering the antistatic surface properties undesirable.

It has not been disclosed that conventional nonionic surface active agents having ethylene oxide added thereto would have a range as to the amount of addition that would substantially satisfy both electrolyte stability as well as eliminating black speckled marks and screen stain.

An important point in the production of photographic materials by the addition of a polymer latex to a silver halide emulsion is the stability of the materials to mechanical pressure from outside sources during production. Measures to increase the stability to mechanical pressure are known, as disclosed in U.S. Pat. No. 3,287,289 and British Patents 1336061 and 1106717, i.e., methods wherein monomers having a carboxylic group or a sulfonic group are copolymerized so that the repelling force of the polymer latex surface may be advantageously used.

However, these techniques improve mechanical stability indeed, but an agglomerate is formed when the polymer latex is added to an emulsion, causing serious problems in the production step.

SUMMARY OF THE INVENTION

Therefore, a first object of the present invention is to provide an improved silver halide photographic material in that the photographic characteristics will not be undesirably altered by pressure or stress exerted thereon before the development treatment.

A second object of the present invention is to provide a silver halide photographic material whose pressure characteristics are good, and that is improved in electrolyte stability of the polymer latex.

A third object of the present invention is to provide a silver halide photographic material whose pressure characteristics are good and that is improved in mechanical stability of the polymer latex.

A fourth object of the present invention is to provide a silver halide photographic material containing at least one silver halide emulsion layer, which is formed by adding a polymer latex into the emulsion without causing the polymer latex to agglomerate, thereby making the polymer latex coarse or causing precipitation of the polymer latex.

A fifth object of the present invention is to provide a silver halide photographic material having good pressure characteristics and antistatic performance.

A sixth object of the present invention is to provide a silver halide photographic material which is good as to pressure characteristics and low in the amount of screen stain.

These and other objects of the present invention are able to be attained by a silver halide photographic material comprising a support having thereon at least one silver halide emulsion layer, the silver halide photographic material containing in the at least one silver halide emulsion layer or at least one other constituting layer a latex having repeating units represented by the following general formula (I):

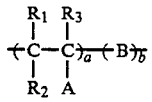

(I)

wherein A represents a group having a dissociating group which has a pKa of about 4 or lower, the pKa being measured at 25° C. in water; $R_l$, $R_2$, and $R_3$, which may be the same or different, each represents a hydrogen atom, a halogen atom, a substituted or unsubstituted alkyl group having 1 to 30 carbon atoms, a substituted or unsubstituted alkenyl group having 1 to 30 carbon atoms, a substituted or unsubstituted aryl group having 1 to 30 carbon atoms, a carboxyl group, an alkyloxy carbonyl group, or an alkylcarbonyloxy group; B represents a unit derived from a monomer copolymerizable with a monomer containing A; and a and b represent numbers of repeating units with a molar ratio of a to b being about 1.5/98.5 to about 50/50; the latex containing at least one compound selected from the group consisting of (a) a polymer having the following general formula (II):

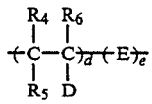

(II)

wherein D represents a hydroxy group or a substituted or unsubstituted polyoxyalkylene group; $R_4$, $R_5$, and $R_6$ have the same meaning as defined above for $R_l$, $R_2$, and $R_3$ in formula (I); E represents a unit derived from a monomer copolymerizable with a monomer containing D and has the same meaning as defined above for B in formula (I); and d and e represent numbers of repeating units with the molar ratio of d to e being about 100/0 to about 5/95, (b) a water-insoluble low molecular weight compound having the following general formula (III):

F—G (III)

wherein F represents a substituted or unsubstituted alkyl, alkenyl, or aryl group having 14 or more carbon atoms; and G represents a hydroxy group, or a substituted or unsubstituted polyoxyalkylene group, (c) a cellulose derivative, or (d) a starch derivative, the at least one compound being present in an amount of about 1.5 wt % or more based on the solid weight of the latex.

DETAILED DESCRIPTION OF THE INVENTION

In a latex having the general formula (I), $R_1$, $R_2$ and $R_3$ may be the same or different and each represents a hydrogen atom, a halogen atom, a substituted or unsubstituted alkyl group having 1 to 30 carbon atoms (e.g., a methyl group, an ethyl group, an isopropyl group, and a hexyl group, etc.), a substituted or unsubstituted alkenyl group having 1 to 30 carbon atoms, a substituted or unsubstituted aryl group having 1 to 30 carbon atoms, a carboxyl group, an alkyloxycarbonyl group, or an alkylcarbonyloxy group, preferably a hydrogen atom, a halogen atom, an alkyl group having 1 to 20 carbon atoms, an alkyloxycarbonyl group, an alkylcarbonyloxy group or a carboxyl group, and more preferably a hydrogen atom, a methyl group, an ethyl group, a chlorine atom or a carboxy group.

A in general formula (I) represents a group having a dissociating group whose pKa is about 4 or lower, and preferably, such dissociating groups of A include a sulfonic group, a sulfate group, a phosphate group, a carboxylic group, etc., more preferably a sulfonic group, a sulfate group, a phosphate group, an α-chloroacetic group, an α-nitroacetic group and a nitrobenzoic group, as well as salts thereof (e.g. alkali metal salts, alkali earth metal salts, ammonium salts and substituted or unsubstituted alkylamine salts having 1 to 10 carbon atoms), and most preferably a sulfonic group and a sulfate group.

B in general formula (I) represents a unit derived from a monomer copolymerizable with a monomer containing A, and may comprise a combination of such monomers.

Specifically, B is a unit derived from alkylene compounds or vinyl compounds, and preferred examples of B are ethylene, propylene, isobutylene, butadiene, isoprene, neoprene, octene, styrene, xylylene, vinyl chloride, vinylidene chloride, vinyl fluoride, tetrafluoroethylene, acrylonitrile, vinyl acetate, allyl alcohol, vinylpyridine, vinylcarbazole, vinylmorpholine, vinylpyrrolidone, maleic anhydride, divinylbenzene, N-substituted or unsubstituted acrylamides or methacrylamides (suitable substituents therefore include an alkyl group having 1 to 30 carbon atoms (e.g., a methyl group, an ethyl group, a propyl group, a butyl group, a hexyl group, an octyl group, a dodecyl group, etc.), an alkenyl group having 1 to 30 carbon atoms or an ary group having 1 to 30 carbon atoms), acrylic acid, methacrylic acid, itaconic acid, maleic acid, and acrylates, methacrylates, itaconates and maleates having a substituted or unsubstituted alkyl, alkenyl, or aryl group having 1 to 30 carbon atoms.

The molar ratio of a to b is from about 1.5:98.5 to about 50:50, preferably 1.5:98.5 to 30:70 and more preferably 2:98 to 15:85.

Examples of latexes represented by general formula (I) and having a dissociating group whose pKa is 4 or lower are shown below; but the present invention should not be construed as being limited thereto:

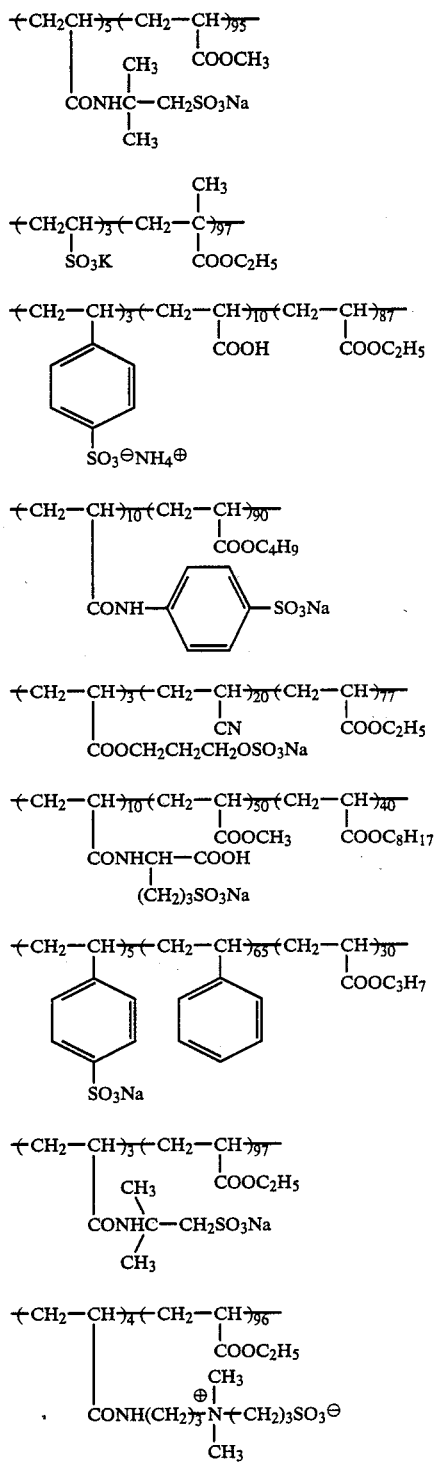

I-1

I-2

I-3

I-4

I-5

I-6

I-7

I-8

I-9

-continued
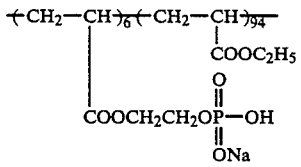
I-10
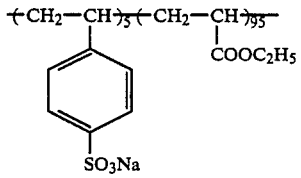
I-11
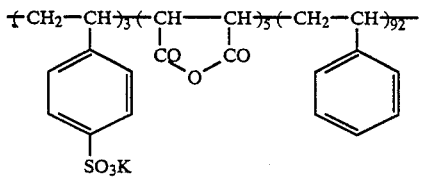
I-12
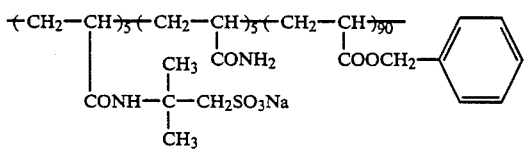
I-13
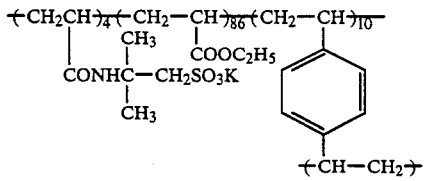
I-14
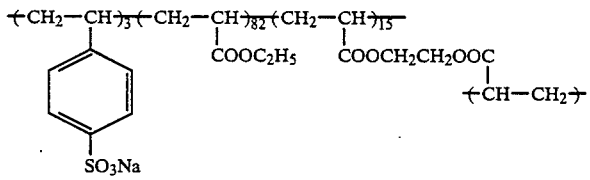
I-15
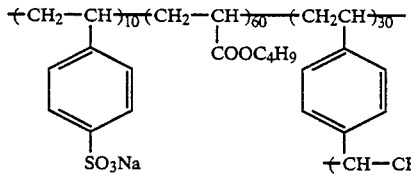
I-16
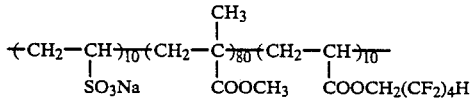
I-17
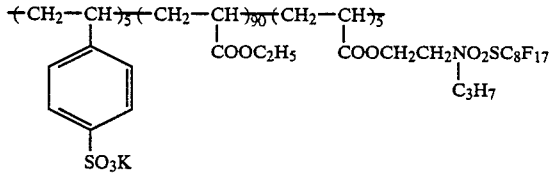
I-18
These latexes contain at least one of compounds represented by general formula (II), compounds represented by general formula (III), cellulose derivatives and starch derivatives, and the method of incorporating such compound(s) into the latex is described hereinafter.

Polymers represented by general formula (II) are described below.

In general formula (II), $R_4$, $R_5$ and $R_6$ may be the same or different, and have the same meaning as defined for $R_1$, $R_2$ and $R_3$ in formula (I). D represents a hydroxy group or a polyoxyalkylene group which may be substituted with a substituent such as a methyl group or a phenyl group. Preferred alkylene moiety is ethylene, propylene, hydroxypropylene, isopropylene, butylene, styrene or tetrafluoroethylene, with ethylene, methylethylene and hydroxypropylene preferred. The polyoxyalkylene group preferably has a molecular weight of about 45–10,000, and more preferably has a molecular weight of about 45–3,000. The polyoxyalkylene group may be bonded directly to the main polymer chain, or may be bonded through a linking group to the main polymer chain. Preferred examples of the linking group include an alkylene group having 1 to 30 carbon atoms (e.g., a methylene group, an ethylene group, a propylene group, and a butylene group, etc.), an arylene group (e.g., a phenylene group, etc.), a carboxyl group, an amide group, an amino group, and a thiol group, etc.

Preferred molar ratio of d to e is about 100/0 to about 95/5 and about 100/0 to about 80/20 is more preferred. E has the same meaning as defined for B in formula (I).

Specific examples of polymers represented by general formula (II) are shown below but the present invention should not be construed as being limited thereto:

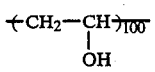
II-1

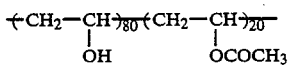
II-2

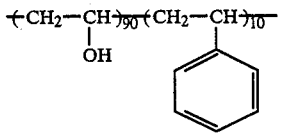
II-3

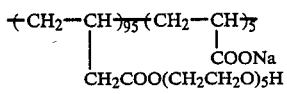
II-4

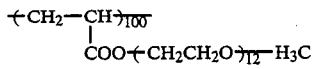
II-5

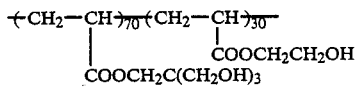
II-6

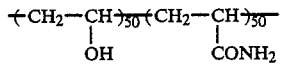
II-7

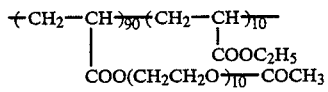
II-8

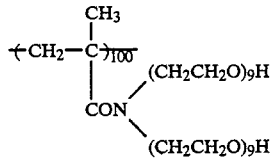
II-9

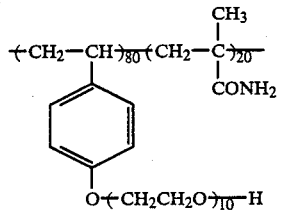
II-10

-continued

II-11

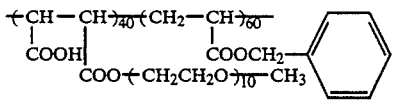

II-12

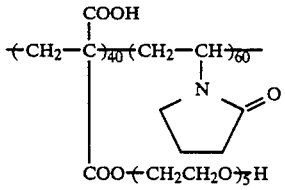

II-13

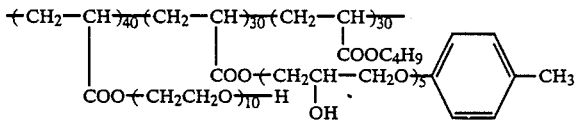

Water-insoluble low molecular weight compounds represented by general formula (III):

$$F—G \qquad (III)$$

wherein F represents a substituted or unsubstituted alkyl, alkenyl, or aryl group having 14 or more carbon atoms (e.g., a tetradecyl group, a hexadecyl group, an octadecyl group, an oleyl group, a p-nonyl phenyl group, a pentadecyl group, a di-nonyl phenyl group, etc.) and G has the same meaning as defined for D in general formula (II), are described below.

The water-insoluble low molecular weight compounds are those whose solubility in water is about 0.5% or below (25° C.), and whose molecular weight is about 300 to 5,000, preferably about 300 to 2,000.

Specific examples of water-insoluble low molecular weight compounds are shown below; but the present invention should not be construed as being limited thereto.

$C_{14}H_{29}O(CH_2CH_2O)_3H$ III-1

$C_{18}H_{37}O(CH_2CH_2O)_5H$ III-2

III-3

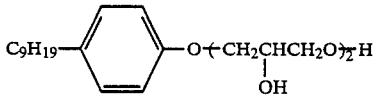

III-4

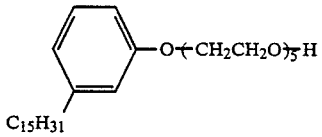

III-5

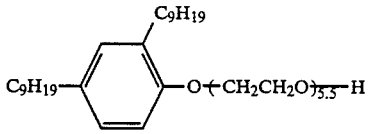

III-6

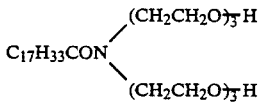

$C_{16}H_{33}—O(CH_2CH_2O)_6H$ III-7

-continued $C_{16}H_{33}O(CH(CH_3)—CH_2O)_2(CH_2CH_2O)_4H$ III-8

$C_{17}H_{35}COO(CH_2CH_2O)_5H$ III-9

$C_{21}H_{43}COO(CH_2CH_2O)_8H$ III-10

Sorbitan monostearate III-11

$C_{22}H_{45}O(CH_2CH_2O)_7H$ III-12

III-13

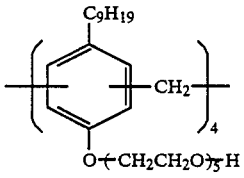

Suitable cellulose derivatives which can be used in the present invention include methyl cellulose, ethyl cellulose, carboxymethylcellulose, sulfated cellulose, hydroxyethyl cellulose, hydroxypropyl cellulose, and alginic acid. Suitable starch derivatives which can be used in the present invention include water-soluble starches such as corn starch, cane starch, rice starch, carboxy starch, methylated starch and dextrin.

In the present invention, it is required that at least one compound (referred to hereinafter as a compound to be latex-incorporated) selected from a polymer represented by general formula (II), a water-insoluble low molecular weight compound represented by general formula III), a cellulose compound and a starch derivative is incorporated into a latex represented by general formula (I). The compound to be latex-incorporated is added either when a latex is synthesized, or a previously synthesized latex may be impregnated with the compound to be latex-incorporated in the following manner. That is, a water-miscible organic solvent in which the compound to be latex-incorporated is dissolved is mixed with a latex previously synthesized, and then the organic solvent is heated and removed under reduced pressure or in a stream of nitrogen, or is removed by dialysis. Suitable organic solvents include those that can be mixed with water and preferably are, for example, methanol, ethanol, propanol, butanol, tetrahydrofurfuryl alcohol, benzyl alcohol, acetone, methyl ethyl ketone, cyclohexanone, methyl acetate, ethyl acetate, methyl formate, dioxane, pyrrolidone, dimethylformamide, dimethylacetamide, acetonitrile ethylene glycol, pyridine and acetic acid. Naturally, water can be mixed with the above solvents, and a mixture of organic solvents can also be used, if desired.

In the present invention, the amount of the compound to be latex-incorporated in a latex represented by general formula (I) is about 1.5 wt % or more, preferably 1.5 to 20 wt %, and more preferably 1.5 to 10 wt %, based on the solid weight of the latex.

In the present invention, the average particle diameter of the polymer latex of general formula (I) is about 0.01 to about 1 μm, preferably 0.02 to 0.4 μm, and the amount of the polymer latex added is about 2 to about 150 wt %, preferably 5 to 100 wt %, based on the weight of the emulsion binder (which is preferably gelatin).

Polymerization initiators useful for the polymerizational polymer latexes of formula (I) of the present invention include azobis compounds, peroxides, hydroperoxides, redox catalysts, for example, potassium persulfate, ammonium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide, azobisisobutylonitrile-2,2'-azobis(2-amidinopropane) hydrochloride, etc.

Emulsifiers which may be used are anionic surface active agents, cationic surface active agents, amphoteric surface active agents, nonionic surface active agents, water-soluble polymers, etc. Examples of the emulsifiers are sodium laurate, sodium dodecyl sulfate, sodium 1-octoxycarbonylmethyl-1-octoxycarbonylmethane sulfonate, sodium laurylnaphthalene sulfonate, sodium laurylbenzene sulfonate, sodium laurate, cetyltrimethylammonium chloride, dodecyltrimethylammonium chloride, N-2-ethylhexylpyridinium chloride, polyoxyethylene nonylphenyl ether, polyoxyethylene sorbitan laurate, N-lauryl, N,N-dimethyl-N-carboxymethyl ammonium, sodium p-octylphenoxyethoxyethanesulfonate, etc.

Since the latex represented by general formula (I) according to the present invention contains dissociating groups having a pKa of about 4 or lower (at 25° C. in water) and at least one compound selected from a polymer represented by general formula (II), a water-insoluble low molecular weight compound represented by general formula (III), a cellulose derivative, and a starch derivative, when the latex is added to an emulsion, an increase in the size of the latex particles, or flocculation or precipitation of the latex particles due to the presence of salts can be prevented. Further, since the latex has a sufficient surface potential even in a low pH range, if the latex is subjected to a mechanical pressure by a liquid feeding pump or the like when it is produced, the latex can be produced in a stable manner without forming black speckled marks.

SYNTHESIS EXAMPLE 1- SYNTHESIS OF COMPOUND I-2 (INCLUDING COMPOUND II-1)

4.76 g of sodium dodecylbenzenesulfonate, 13.6 g of polyvinyl alcohol (molecular weight:50,000, Compound II-1) and 1600 g of water were kept at 50° C. with stirring. After 23.9 g of a mixture of vinylsulfonic acid and ethyl acrylate (containing 3 mol % of vinylsulfonic acid) were added thereto dropwise over 30 min, a solution of 1.65 g of potassium persulfate and 1.10 g of sodium bisulfate in 125 g of water were added dropwise over 30 min. Further, 452 g of a mixture of vinylsulfonic acid and ethyl acrylate (containing 3 mol % of vinylsulfonic acid) were added dropwise thereto over 90 min. In that case, a mixture of 1.65 g of potassium persulfate and 1.10 g of sodium bisulfate in 125 g of water was added at the start of the addition and after the addition. Then, after the reaction mixture was stirred for 2 hours, it was heated to 90° C., was stirred for 6 hours, and was cooled, and the pH of the reaction mixture was adjusted to 4.0 by 20% sodium hydroxide to obtain 2180 g of the intended polymer latex, Compound I-2 (Solid weight: 24 wt %, Yield:98%).

SYNTHESIS EXAMPLE 2 - SYNTHESIS COMPOUND I-8 (INCLUDING COMPOUND II-5)

Synthesis Example 1 was repeated, except that N-sulfobutyl acrylamide was used instead of vinylsulfonic acid, and Compound II-5 was used instead of Compound II-1, thereby obtaining 2110 g of the intended latex, Compound I-8 (Solid weight:23.5 wt %, Yield: 95%).

SYNTHESIS EXAMPLE 3 - SYNTHESIS OF COMPOUND I-11 (INCLUDING COMPOUND III-2)

4.76 g of sodium dodecylbenzenesulfonate and 1600 g of water were kept at 50° C. with stirring. After a mixture of 23.9 g of styrenesulfonic acid and methyl methacrylate (containing 5 mol % of styrenesulfonic acid), to which 1.2 g of Compound III-2 had been added, was added dropwise to the resulting solution over 30 min, a solution of 1.65 g of potassium persulfate and 1.10 g of sodium bisulfate in 125 g of water was added dropwise over 30 min. Further, 472 g of a solution of styrenesulfonic acid, methyl methacrylate and Compound III-2 (containing 5 mol % of styrenesulfonic acid) were added dropwise over 90 min.

Thereafter, the reaction was carried out in the same manner as in Synthesis Example 1, thereby obtaining 2,220 g of the intended latex, Compound I-11 (Solid weight; 22.7 wt %, Yield: 98.7%).

SYNTHESIS EXAMPLE 4 - SYNTHESIS OF COMPOUND I-15 (INCLUDING COMPOUND III-8)

4.76 g of sodium-α-sulfosuccinic acid dioctyl ester and 1600 g of water were kept at 50° C. with stirring. After 23.9 g of a liquid mixture of styrenesulfonic acid, ethyl acrylate and ethylene glycol methacrylate (having a molar ratio of 3:82:15) was added dropwise to that aqueous solution over 30 min, 1.65 g of potassium persulfate and 1.1 g of sodium bisulfate in 125 g of water was added dropwise over 30 min. Then, 452 g of a liquid monomer mixture of styrenesulfoni acid, ethyl acrylate and ethylene glycol methacrylate (having a molar ratio of 3:82:15) were added dropwise over 90 min. In that case, a mixture of 1.65 g of potassium persulfate and 1.1 g of sodium bisulfate in 125 g of water was added at the start of the addition and after the addition. Thereafter, the reaction mixture was stirred for 2 hours, was then heated to 90° C. and was stirred for 6 hours to produce a latex.

A solution of 14.3 g of Compound III-8 and 300 cc of acetone was added to the thus produced latex solution, the mixture was stirred for 2 hours at 50° C. and the acetone was removed under reduced pressure. The latex containing Compound III-8 was neutralized with 10% sodium hydroxide to obtain 2,109 g of the intended latex, Compound I-15 (Solid weight:23.6 wt %, Yield: 94.9%).

The present photosensitive materials can be used for conventional black and white silver halide photographic materials (e.g. black and white photosensitive materials for photography, black and white photosensitive materials for X-rays, black and white photosensitive materials for printing, etc.), conventional multilayer color photographic materials (e.g. color reversal films, color negative films, color positive films, etc.), etc. The present photosensitive materials are highly effective when used for silver halide photosensitive materials which undergo high temperature rapid processing, and also as high speed silver halide photosensitive materials.

Silver halide grains in the photographic emulsion used in the present photographic materials may be any one of regular crystals, such as cubic crystals and octahedral crystals, irregular crystals, such as spherical crystals and platelike crystals, or any combination of these. Tabular grains as described in *Research Disclosure,* 225, No. 22534, pages 20–58 (January, 1983) can also be employed. The silver halide grains may consist of a mixture of grains having different crystal forms.

The emulsions used in the present invention may be an emulsion mixture of a photosensitive silver halide emulsion with an internally fogged silver halide emulsion, or may be a combination of separate layers as described in U.S. Pat. Nos. 2,996,382, 3,397,987 and 3,705,858. In this case, it is preferable to use a mercapto compound, such as described in Japanese Patent Application (OPI) No. 48832/86 (the term "OPI" as used herein means a "published unexamined Japanese Patent Application"), for example, in view of suppression of fog and improvement in storability with time.

The photographic emulsions used in the present invention can be prepared by methods, for example, described by P. Glafkides in *Chimie et Physique Photographique,* published by Paul Montel (1967), by G. F. Duffin in *Photographic Emulsion Chemistry,* published by The Focal Press (1966), and by V. L. Zelikman et al in *Making and Coating Photographic Emulsion,* published by The Focal Press (1964).

If necessary, dyes (e.g. magenta, cyan and yellow dyes) can be used in the silver halide emulsion layer used in the present invention. For example, the dyes described in *Research Disclosure,* Vol. 176, No. 17643, § VIII, can be used. Magenta dyes as described in Japanese Patent Application (OPI) No. 285445/86 can be used to improve the tone of developed silver.

Photographic layers of the silver halide photosensitive materials according to the present invention are now described briefly below.

Suitable binders for the photographic layers include proteins such as gelatin and casein; cellulose compounds such as carboxymethylcellulose and hydroxyethylcellulose; sugar derivatives such as starch derivatives, dextran agar and sodium alginate; synthesized hydrophilic colloids such as polyvinyl alcohol, poly-N-vinylpyrrolidone, polyacrylic acid copolymers and polyacrylamide, or their derivatives and partially hydrolyzed products that can be used in combination.

Herein, gelatin refers to so-called lime-processed gelatin, acid-processed gelatin, derivative gelatin or enzyme-processed gelatin.

With respect to types of silver halides, methods of producing them, chemical sensitization methods, antifoggants, stabilizers, hardening agents, antistatic agents, plasticizers, lubricants, coating aids, matting agents, brightening agents, spectral sensitizers, dyes, color couplers, etc. which can be used in the surface protective layers, and silver halide emulsion layers, etc. of the present photographic materials, there is no particular limitation, and reference may be made to descriptions in *Product Licensing,* Vol. 92, pages 107–110 (December, 1971) and *Research Disclosure,* Vol. 176, pages 22–31 (December, 1978) and *Research Disclosure,* Vol. 238, pages 44–46 (1984).

In particular, suitable antifoggants and stabilizers include a large number of compounds, such as heterocyclic compounds, for example, 4-hydroxy-6-methyl-1,-3,3a,7-tetraazaindene-3-methylbenzothiazole and 1-phenyl-5-mercaptotetrazole nitron and its salts (e.g. its salicylate, nitrate, etc.), mercury-containing compounds, mercapto compounds, metal salts such as palladium chloride and its sodium salt, and bromo-palladium and its ammonium salt. Examples of hardening agents are aldehyde type compounds such as glutaraldehyde, glyoxal, dimethylol urea, formaldehyde, mucophenoxychloric acid, mucochloric acid and mucobromic acid; active vinyl type compounds such as divinyl sulfone, methylenebismaleimide, 5-acetyl-1,3-diacryloyl-hexahydro-s-triazine, 1,3,5-triacryloyl-hexahydro-s-triazine, 1,3,5-trivinylsulfonylhexahydro-s-triazinebis(-vinylsulfonylmethyl) ether, 1,3-bis(vinylsulfonylmethyl)propanol-2, and bis(α-vinylsulfonylacetamide)ethane; and active halogen type compounds such as 2,4-dichloro-6-hydroxy-s-triazine sodium salt, and 2,4-dichloro-6-methoxy-s-triazine.

The photographic emulsion layer of the photosensitive material obtained according to the present invention, or other hydrophilic colloid layer(s) may contain various surface active agents for the various purposes of, for example, coating assistance, preventing static charge, improving sliding properties, emulsifying and dispersing, preventing adhesion, and improving photographic characteristics (e.g. facilitating development, providing high contrast, and sensitizing).

For example, nonionic surface active agents, such as saponins (of the steroid type), alkylene oxide derivatives (e.g. polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkyl-amines or-amides, and polyethylene oxide adducts of silicones), glycidol derivatives (e.g. alkenylsuccinic acid polyglycerides, and alkylphenol polyglycerides), fatty acid esters of polyhdric alcohols and alkyl esters of sugars; anionic surface active agents having an acid group such as a carboxy group, a sulfo group, a phospho group, a sulfuric ester group and a phosphoric ester group, for example, alkyl carboxylates, alkyl sulfonates, alkylbenzene sulfonates, alkylnaphthalene sulfonates, alkyl sulfates, alkyl phosphates, N-acyl-N-alkyltaurines, sulfosuccinates, sulfoalkyl polyoxyethylenealkylphenyl ethers and polyoxyethylenealkyl phosphates; amphoteric surface active agents such as amino acids, aminoalkyl sulfonates, aminoalkyl sulfates, aminoalkyl phosphates, alkylbetaines and amine oxides; and cationic surface active agents such as alkyl amine salts, aliphatic or aromatic quaternary ammonium salts, quaternary ammonium salts of heterocyclic compounds such as pyridinium or imidazolium compounds, and phosphonium or sulfonium salts containing aliphatic groups or heterocyclic rings.

These compounds are described, for example, by Ryohei Oda et al in *Surfactants and Their Application* (*Kaimenkasseizai To Sono Oyo*), published by Maki Shoten (1964); by Hiroshi Hori in *New Surface Active Agents* (*Shinkaimen Kasseizai*), published by Sankyo Shuppan K.K. (1975); or in *Mc Cutcheon's Detergents & Emulsifiers,* Mc Cutcheon Divisions, Mc Publishing Co., (1985) and Japanese Patent Application (OPI) No. 76741/85.

Antistatic agents which can preferably be used are fluorine-containing surface active agents or polymers nonionic surface active agents described, for example, in Japanese Patent Application (OPI) Nos. 76742/85, 80846/85, 80848/85, 80839/85, 76741/85 and 208743/83 or electro-conductive polymers or latexes (of the nonionic, anionic, cationic and amphoteric types) described in Japanese Patent Application (OPI) No. 204540/82. Also, inorganic antistatic agents preferably include, for example, halides, nitrates, perchlorates, sulfates, acetates, phosphates and thiocyanates of ammonium alkali metals and alkali earth metals and electroconductive tin oxide, zinc oxide and complex oxides obtained by doping these metal oxides with antimony or the like as described, for example, in Japanese Patent Application (OPI) No. 118242/82. Various charge-transfer complexes, $\pi$-conjugate system high polymers that may be doped, intercalate such as graphite and zirconium phosphate, organic metal compounds, etc. such as tetracyanoquinodimethane/tetrathiafulvalene (TCNQ/TTF), polyacetylene and polypyrrole can also be used as antistatic agents. These compounds are described, for example by Morita et. al in *Kagaku To Kygyo,* 59, (3), pp. 103–111 (1985) and 59, (4), pp. 146–152 (1985).

Further, in the present invention, ultraviolet absorbing agents such as benzotriazole type, benzophenone type, cinnamic acid type, aminobutadiene type and thiazolidone type ultraviolet absorbing agents as described in Japanese Patent Publication Nos. 5496/73, 10726/75, 21141/81, and 19771/82 can be used.

The present invention will be further described with reference to the following Examples, which should not, however, be construed as limiting the scope of the present invention in any manner whatsoever. Unless otherwise indicated, all parts, percents, ratios and the like are by weight.

EXAMPLE 1

(1) Preparation of Tabular Silver Halide Grains

To an aqueous solution of potassium bromide, a thioether ($HO(CH_2)_2S(CH_2)_2S(CH_2)_2OH$) and gelatin kept at 70° C., was added a solution mixture of a silver nitride solution and a solution of potassium iodide and potassium bromide by the double-jet method. After the completion of the addition, the temperature was lowered to 35° C., the soluble salts were removed by a flocculation process, then the temperature was raised to 40° C., 60 g of gelatin were added, and the pH was adjusted to 6.8. The thus obtained tabular silver halide grains had an average diameter of 1.25 $\mu$m, a thickness of 0.15 $\mu$m, an average diameter/thickness ratio of 8.33 and a silver bromide content of 3 mol %. The pAg was 8.95 at 40° C.

This emulsion was then chemically sensitized using a combination of gold sensitization and sulfur sensitization methods. After chemical sensitization, the solution was subjected to green sensitization by adding 500 mg of a sensitizing dye, that is, anhydro-5,-5'-dichloro-9-ethyl-3,3'-di(3-sulfopropyl)oxacarbocyaninehydroxide sodium salt, and 200 mg of potassium iodide per mol of silver. Further, as a stabilizer, 4-hydroxy-6-methyl-1,3,3a,7-tetraazaindene and 2,6-bis-(hydroxyamino)-4-diethylamino-1,3,5-triazine and a polyacryl amide having a weight-average molecular weight ($\overline{M}w$) of 60,000 were added to obtain a coating liquid for a tabular emulsion. The specific gravity of the coating liquid was 1.175, the weight ratio of silver/gelatin was 1.30, and the weight ratio of polyacrylamide/gelatin was 0.30.

(2) Addition of the Emulsion to Latexes

The tabular silver halide emulsion prepared in step (1) above was added to each of latexes according to the present invention as shown in Table 1. The latex/gelatin weight ratio was 0.35.

(3) Preparation of a Coating Liquid for the Surface Protective Layer

A 10% aqueous gelatin solution consisting of gelatin, a nonionic surface active agent compound (Triton X-100, produced by Rohm & Haas Co.), a coating agent (Triton X-200, produced by Rohm & Haas Co.), a fluorine-containing surface active agent ($C_8F_{17}SO_2K$), polymethyl methacrylate particles (having an average particle size of 3.6 $\mu$m) as a matting agent, 2,4-dichloro-6-hydroxy-1,3,5-triazine sodium salt as a hardening agent and a polyacrylamide having a weight-average molecular weight ($\overline{M}w$) of 60,000, was prepared to be used as a coating liquid for the surface protective layer.

(4) Method of the Preparation of Photographic Materials

First the emulsion layer, and then the surface protective layer, were coated on a polyethylene terephthalate film support that had been coated with a primary coat and had a thickness of 180 $\mu$m by the coextrusion coating method, followed by drying such that the amount of coated silver was 2.0 g/m$^2$ and in the surface protective layer the amount of the gelatin was 1.5 g/m$^2$, the amount of the nonionic surface active agent was 35 mg/m$^2$, the amount of Triton X-200 was 15 mg/m$^2$, the amount of the fluorine-containing surface active agent was 6.0 mg/m$^2$, the amount of the matting agent was 40 mg/m$^2$, the amount of the hardening agent was 10 mg/m$^2$ and the amount of the polyacrylamide was 0.3 g/m$^2$. The opposite surface of the support was coated in the same way to have the same constitution.

(5) Method of Evaluating the Electrolyte-Stability of the Latex

After each emulsion liquid containing a latex that had been obtained in step (2) above was stirred at 40° C. for one day while keeping warm, it was allowed to stand for 2 hours, and was coated as mentioned above. The stability was evaluated and graded into the following three classes:

A: precipitation of the emulsion did not occur, and there was no abnormality of the surface state after the coating application and drying.

B: precipitation of the emulsion was not observed, but the surface state after the coating application and drying was deteriorated and could not be used in practice.

C: the emulsion was precipitated and separated from the aqueous solution.

(6) Method of Evaluating The Mechanical Stability of the Latex

The latex was tested by the malone method that is conventionally used to evaluate the mechanical stability of polymer latexes. The test was carried out such that the load was 10 kg, and the time of revolution was 15 min, and the latex was diluted ten times. The pH was varied by using NaOH and HCl. The stability was evaluated and graded into the following four classes:

A: no flocculation of the latex was observed.

B: the amount of flocculation was 5% or less of the amount of the latex.

C: the amount of flocculation was 5 to 20% of the amount of the latex.

D: the amount of flocculation was 20% or more to the amount of the latex.

(7) Method of Evaluating The Pressure Charcteristics

Each of the thus obtained coated film samples was bent under conditions wherein the temperature was adjusted to 25° C. and the relative humidity was adjusted to 40%. The bending was such that the sample was bent around an iron bar having a diameter of 6 mm through an angle of 180° C. Immediately after that, each sample underwent wedge exposure for $10^{-2}$ sec. The thus-exposed samples were developed for 25 sec with Developing Solution RD-III (manufactured by Fuji Photo Film Co., Ltd.), and after the sample was fixed with Fixer Fuji-F (manufactured by Fuji Photo Film Co., Ltd.), the sample was washed and dried. The ratio, $\Delta Fog/D_{max}$, of the amount of change in the formation of fog due to the bending ($\Delta Fog$) to the maximum density ($D_{max}$) is given in Table 1, and the logarithm of the reciprocal number of the amount of light at a point where the optical density increased by 0.1 from the fog was defined as the sensitivity of the emulsion, and the amount of change in the sensitivity due to the bending was expressed as $\Delta S$, which is also given in Table 1.

(8) Method of Evaluating The Pressure Fog (Black Speckled Marks) in the Developing Solution Each of the samples was cut into pieces measuring 40 mm by 240 mm, and these pieces were exposed so as to have an exposed section wherein the density would be about 1.0 when developed, an exposed section wherein the density would be about 0.5 when developed, and an unexposed section. Each exposed sample was developed for 10 sec at 35° C. with Developing Solution RD-III (manufactured by Fuji Photo Film Co., Ltd.), and then was quickly passed at a feeding speed of 40 mm/sec between a pair of pressing rolls (made of a phenolic resin, and having an outer diameter of 30 mm, a length of 60 mm and a pressing force of 2 kg) that were rotated synchronously. Then, each sample was again developed for 10 sec with Developing Solution RD-III. The sample was fixed with Fixer Fuji-F (manufactured by Fuji Photo Film Co., Ltd.), and was washed and dried. Each sample was examined as to the occurrence of a black speckled marks, and the presence black speckled marks was graded into the following four classes:

A: there was no occurrence of black speckled marks.

B: there was a minor occurrence of black speckled marks.

C: there was occurrence of black speckled marks.

D: there was remarkable occurrence of black speckled marks.

(9) Method of Evaluating the Degree of Screen Stain

Each sample and Screen LT-II (manufactured by Dai Nippon Toryo Co., Ltd.) were subjected to moisture conditioning for 1 day at a temperature of 30° C. and a relative humidity of 80%; 100 of the sample pieces were passed through a cassette using LT-II under the same conditions; a new film was exposed to X-rays using the cassette; the film was developed at 35° C. for 25 sec with Developing Solution RD-III (manufactured by Fuji Photo Film Co., Ltd.), and the degree of non-uniformity of the density after washing and drying was examined. The evaluation of the degree of screen stain was made according to the following four grades:

A: occurrence of non-uniformity of the density was not observed.

B: minor occurrence of non-uniformity of the density was observed.

C: considerable occurrence of non-uniformity of the density was observed.

D: remarkable occurrence of non-uniformity of the density was observed.

(10) Method of Evaluating Occurrence of Static Marks

A rubber sheet and the surface protective layer of each of the unexposed samples were brought in contact, and after a rubber roller was pressed thereon, they were separated to see whether static marks occurred. Each sample was subjected to moisture conditioning at a temperature of 25° C. and a relative humidity of 25% for one day, and the static mark occurrence test was carried out under the same temperature and humidity conditions. After the test, each of the samples was developed at 35° C. for 25 sec with Developing Solution RD-III (manufactured by Fuji Photo Film Co., Ltd.), was fixed with Fixer Fuji-F (manufactured by Fuji Photo Film Co., Ltd.), and washed and dried. The degree of occurrence of static marks was graded into the following three grades:

A: occurrence of static marks was not observed.

B: minor occurrence of static marks was observed.

C: remarkable occurrence of static marks was observed.

Comparative Latex (A):

$$\left(CH_2\underset{\substack{|\\ COOH}}{CH}\right)_3\left(CH_2\underset{\substack{|\\ COOC_2H_5}}{CH}\right)_{97}$$

Comparative Compound (B):

$$C_{12}H_{25}O\left(CH_2CH_2O\right)_{10}H$$

(Japanese Patent Publication No. 54782/82)

TABLE 1

| Sample No. | Latex | Compound that is to be latex-incorporated: Compound | Added amount (based on the latex) | Electrolyte stability of latex | Mechanical stability of latex: Evaluation | pH | Pressure characteristics: Fog/ΔD max | ΔS | Black speckled marks | Screen stain | Static marks |
|---|---|---|---|---|---|---|---|---|---|---|---|
| 1 (Blank) | — | — | — | — | — | — | 0.12 | 0.09 | A | A | A |
| 2 (Invention) | Compound I-2 | Compound II-1 | 3% | A | A | 3.5 | 0.02 | 0.03 | A | A | A |
| 3 (Invention) | Compound I-2 | Compound II-4 | 3% | A | A | 4 | 0.02 | 0.02 | A | A | A |
| 4 (Invention) | Compound I-2 | Compound III-2 | 3% | A | A | 3.5 | 0.03 | 0.03 | A | A | A |
| 5 (Invention) | Compound I-2 | Methyl Cellulose | 5% | A | A | 4 | 0.04 | 0.02 | A | A | A |
| 6 (Invention) | Compound I-8 | Methyl Cellulose | " | A | A | 4 | 0.03 | 0.02 | A | A | A |
| 7 (Invention) | Compound I-8 | II-10 | 3 | A | A | 4 | 0.02 | 0.03 | A | A | A |
| 8 (Invention) | Compound I-11 | III-9 | 3 | A | A | 4 | 0.03 | 0.01 | A | A | A |
| 9 (Invention) | Compound I-16 | II-8 | 4 | A | A | 4 | 0.03 | 0.02 | A | A | A |
| 10 (Invention) | Compound I-16 | Hydroxyethylcellulose | 4 | A | A | 4 | 0.02 | 0.02 | A | A | A |
| 11 (Invention) | Compound I-5 | II-2 | 3 | A | A | 4 | 0.03 | 0.02 | A | A | A |
| 12 (Invention) | Compound I-11 | II-1 | 3 | A | A | 4 | 0.02 | 0.01 | A | A | A |
| 13 (Invention) | Compound I-1 | II-2 | 3.5 | A | A | 4 | 0.03 | 0.02 | A | A | A |
| 14 (Invention) | Corn Starch | II-2 | 3.5 | A | A | 4 | 0.02 | 0.02 | A | A | A |
| 15 (Comparison) | Compound I-1 | — | — | C | A | 4 | Measurement was impossible to obtain a sample because the latex flocculated when applied. | | | | |
| 16 (Comparison) | Comparative Compound A | II-1 | 3 | A | D | 3.5 | 0.02 | 0.03 | A | A | A |
| 17 (Comparison) | Compound I-1 | Comparative Compound B | 3 | A | A | 3.5 | 0.03 | 0.03 | D | D | C |

As shown in Table 1, Sample (1), which did not contain the latex of the present invention was quite poor in pressure characteristics. In contrast, Sample Nos. 2 to 14 containing polymer latexes according to the present invention were improved in pressure characteristics, good in electrolyte stability and mechanical stability of the latexes and good with respect to formation of black speckled marks, screen stain and static marks.

On the other hand, Comparative Sample No. 15, which did not contain a compound to be latex-incorporated, the electrolyte stability was poor, the emulsion precipitated before the coating application, so that a film could not be practically prepared. Since Comparative Sample No. 16 used Comparative Latex (A) are a latex, Comparative Sample No. 16 was considerably poorer in mechanical stability, and practical trouble occurred when it was produced. In Comparative Sample No. 17, instead of a compound to be latex-incorporated according to the present invention, a nonionic surface active agent (Comparative Compound B) was used, and although the latex itself was good in stability, it was unavoidable that the formation of black speckled marks, screen stain and static marks were worse from a practical standpoint.

As described above, when a latex according to the present invention was added to a photographic material, a photographic material with an excellent image quality results.

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having thereon at least one silver halide emulsion layer, wherein said at least one silver halide emulsion layer or at least one other hydrophilic colloid layer contains in addition to a binder, as component (A), a polymer latex having repeating units represented by the following general formula (I):

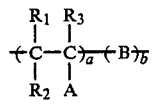

(I)

wherein A represents a group having a dissociating group which has a pKa of about 4 or lower, said pKa being measured at 25° C. in water; $R_1$, $R_2$, and $R_3$, which may be the same or different, each represents a hydrogen atom, a halogen atom, a substituted or unsubstituted alkyl group having alkenyl group having 1 to 30 carbon atoms, a substituted or unsubstituted aryl group having 1 to 30 carbon atoms, a carboxyl group, an alkyloxycarbonyl group, or an alkycarbonyloxy group; B represents a unit derived from a monomer copolymerizable with a monomer containing A; and a and b represent numbers a repeating units with a molar ratio of a to b being about 1.5/98.5 to about 50/50; and wherein said polymer latex is admixed with, an component (B), a compound selected from the group consisting of (a) a polymer having the following general formula (II):

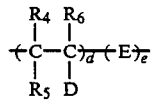

(II)

wherein D represents a hydroxy group or a substituted or unsubstituted polyoxyalkylene group; $R_4$, $R_5$ and $R_6$ have the same meaning as defined above for $R_1$, $R_2$, and $R_3$ in formula (I); E represents a unit derived from a monomer copolymerizable with a monomer containing D and has the same meaning as defined above for B in formula (I); and d and e represent numbers of repeating units with the molar ratio of d to e being about 100/0 to about 5/95, (b) a water insoluble compound having a molecular weight of 300 to 5,000 and having the following general formula (III):

F—G (III)

wherein R represents a substituted or unsubstituted alkyl, alkenyl or aryl group having 14 or more carbon atoms; and G represents a hydroxy group, or a substituted or unsubstituted polyoxyalkylene group, (c) a cellulose derivative selected from the group consisting of methyl cellulose, ethyl cellulose, carboxymethylcellulose, sulfated cellulose, hydroxyethyl cellulose, hydroxypropyl cellulose, and alginic acid, or (d) a starch derivative selected from the group consisting of corn starch, cane starch, rice starch, carboxyl starch, methylated starch and dextrin, and mixtures of (a)-(d), wherein said component (B) is present in an amount of about 1.5 wt % or more based on the solid weight of the polymer latex, and wherein the average particle diameter of said polymer latex is about 0.01 to about 1 μm and the polymer latex added to said at least one silver halide emulsion layer or other hydrophilic colloid layer in an amount of about 2 to about 150 wt % based on the weight of a binder in the emulsion layer or other hydrophilic colloid layer, respectively.

2. A silver halide photographic element as claimed in claim 1, wherein said B represents a unit derived from alkylene compounds or vinyl compounds.

3. A silver halide photographic element as claimed in claim 1, wherein said molar ratio of a to b is 1.5:98.5 to 30:70.

4. A silver halide photographic element as claimed in claim 3, wherein said molar ratio of a to b is 2:98 to 15:85.

5. A silver halide photographic element as claimed in claim 1, wherein said water-soluble compound having a molecular weight of 300 to 5000 has a solubility in water of about 0.5% or lower at about 25° C.

6. A silver halide photographic element as claimed in claim 1, wherein said Component (B) is present in said polymer latex in an amount of 1.5 to 20 wt % based on the solid weight of the polymer latex.

7. A silver halide photographic element as claimed in claim 6, wherein said component (B) is present in said polymer latex in an amount of 1.5 to 10 wt %, based on the solid weight of the polymer latex.

8. A silver halide photographic element as claimed in claim 1, wherein A of general formula (I) is selected from the group consisting of a sulfonic group, a sulfate group and a phosphate group.

* * * * *